US009406471B2

(12) United States Patent
Pickhard

(10) Patent No.: US 9,406,471 B2
(45) Date of Patent: Aug. 2, 2016

(54) REED WITH HINGE FOR REED SWITCH

(71) Applicant: Mark Pickhard, Lake Mills, WI (US)

(72) Inventor: Mark Pickhard, Lake Mills, WI (US)

(73) Assignee: LITTELFUSE, INC., Chicago, IL (US)

( * ) Notice: Subject to any disclaimer, the term of this patent is extended or adjusted under 35 U.S.C. 154(b) by 29 days.

(21) Appl. No.: 14/218,247

(22) Filed: Mar. 18, 2014

(65) Prior Publication Data

US 2015/0270082 A1 Sep. 24, 2015

(51) Int. Cl.

| | |
|---|---|
| ***H01H 51/28*** | (2006.01) |
| ***H01H 1/58*** | (2006.01) |
| ***H01H 36/00*** | (2006.01) |
| ***H01H 49/00*** | (2006.01) |
| ***H01H 50/02*** | (2006.01) |
| ***H01H 50/14*** | (2006.01) |
| *H01H 11/00* | (2006.01) |

(52) U.S. Cl.

CPC ..... *H01H 51/28* (2013.01); *H01H 1/5822* (2013.01); *H01H 36/006* (2013.01); *H01H 49/00* (2013.01); *H01H 50/02* (2013.01); *H01H 50/14* (2013.01); *H01H 51/287* (2013.01); *H01H 11/005* (2013.01); *Y10T 29/49105* (2015.01)

(58) Field of Classification Search

CPC ..... H01H 51/28; H01H 51/287
USPC ..... 335/151, 154
See application file for complete search history.

(56) References Cited

U.S. PATENT DOCUMENTS 5,883,556 A 3/1999 Shutes

FOREIGN PATENT DOCUMENTS

JP 2005317360 A 11/2005
JP 2007157430 A 6/2007

OTHER PUBLICATIONS

European Search Report from corresponding EP Application No. EP15150908.0.

*Primary Examiner* — Ramon M Barrera

(57) ABSTRACT

A reed for a reed switch and a reed switch are provided. The reed may include a first portion having a first thickness and a first length, a second portion having a second thickness and a second length, and a hinged portion disposed between the first portion and the second portion, the hinged portion having a third thickness and a third length, wherein the third length is less than 150% of the first thickness and the third thickness is less than each of the first thickness and the second thickness. The reed switch may include the reed disposed in an insulating housing with a reed deformer to deform the reed.

6 Claims, 8 Drawing Sheets

REED WITH HINGE FOR REED SWITCH

FIELD OF THE DISCLOSURE

This disclosure relates generally to the field of reed switches and particularly to reeds for reed switches.

BACKGROUND OF THE DISCLOSURE

Reed switches are used in a variety of devices, such as, for example, relays, sensors, or the like. A reed switch includes two electrically conducting reeds where at least one of the reeds has a flexible portion. The reeds are disposed in an insulating housing with a gap between end portions of the reeds. The gap can be selectively closed to close the switch and allow conduction of electric current through the reeds. For example, magnetic force may be applied to the reeds to cause the reed with the flexible portion to deform and close the gap.

In general, the reeds are formed from sections of round wire, with the flexible portion formed by flattening a portion of one of the reeds. For example, one of the reeds may have a section flattened in a punch press to form a flexible portion. As will be appreciated, however, when the flexible portion is flattened, the cross-sectional area of the flexible portion increases. For example, FIGS. 1A-1B illustrate side and top views, respectively, of a conventional reed 100 for a reed switch. As depicted, the reed 100 includes a terminal portion 110, a flexible portion 120, and a contact pad portion 130. The flexible portion 120 and the contact pad portion 130 have been flattened. More particularly, as can be seen from FIG. 1A, the flexible portion 120 and the contact pad portion 130 are thinner than the terminal portion. However, due to the flattening processes, the flexible portion 120 and the contact pad portion 130 expand outward in a direction generally orthogonal to the direction in which the portions are flattened. More particularly, as can be seen from FIG. 1B, the flexible portion 120 and the contact pad portion 130 are wider than the terminal portion 110.

FIG. 1C illustrates a perspective view of the reed 100. As depicted, the reed is formed from a section of round wire. Terminal portion 110, flexible portion 120, and contact pad portion 130 are depicted. The flexible portion 120 and the contact pad portion 130 are thinner than the terminal portion 110, but also wider than the terminal portion 110.

To make a reed switch, the reed 100 and another reed are fixed in an insulating housing, such as, a glass tube. Typically, the reed 100 is fixed in the housing near the edge of the terminal portion 110 and the flexible portion 120. During operation, the reed 100 deforms at the flexible portion 120 and the contact pad 130 touches the other reed to close the switch and allow conduction of electric current through the reeds. However, due to the increased width of the flexible portion 120, interference with the insulating housing may prevent the reed 100 from deforming as intended.

Thus, there is a need for reeds that may not interference with the insulating housing when assembled or deformed.

SUMMARY

In accordance with the present disclosure, a reed for a reed switch is provided. The reed may include a first portion having a first thickness and a first length, a second portion having a second thickness and a second length, and a hinged portion disposed between the first portion and the second portion, the hinged portion having a third thickness and a third length, wherein the third length is less than 150% of the first thickness and the third thickness is less than each of the first thickness and the second thickness.

In accordance with the present disclosure, a reed switch is provided. The reed switch may include a first electrically conductive reed comprising a terminal portion and a first portion, a second electrically conductive reed comprising a terminal portion having a first thickness and a first length, a first portion having a second thickness and a second length, and a hinged portion disposed between the first portion and the second portion, the hinged portion having a third thickness and a third length, and an insulating housing having a cavity, wherein the first electrically conductive reed and the second electrically conductive reed are partially disposed in the insulating housing such that the terminal portions extend out from the insulating housing and the first portions are proximate to each other in the cavity, and wherein the third length is less than 150% of the first thickness and the third thickness is less than each of the first thickness and the second thickness.

In accordance with the present disclosure, a method of forming a reed for a reed switch is provided. The method may include providing an electrically conductive reed and stamping the electrically conductive reed to form a hinged portion disposed between a first portion and a second portion, the first portion having a first thickness and a first length, the second portion having a second thickness and a second length, and the hinged portion having a third thickness and a third length, wherein the third length is less than 150% of the first thickness and the third thickness is less than each of the first thickness and the second thickness.

BRIEF DESCRIPTION OF THE DRAWINGS

By way of example, specific embodiments of the disclosed device will now be described, with reference to the accompanying drawings, in which.

DETAILED DESCRIPTION

Figure 1A:
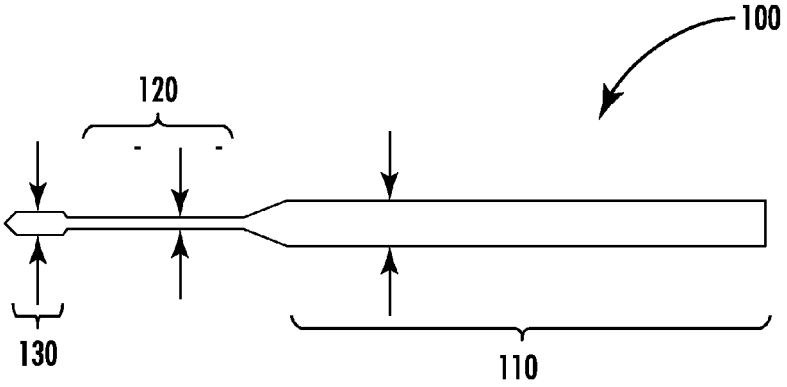
FIG. 1A (PRIOR ART)
FIGS. 1A-1B are side and top views, respectively of a conventional reed for a reed switch.
Figure 1B:
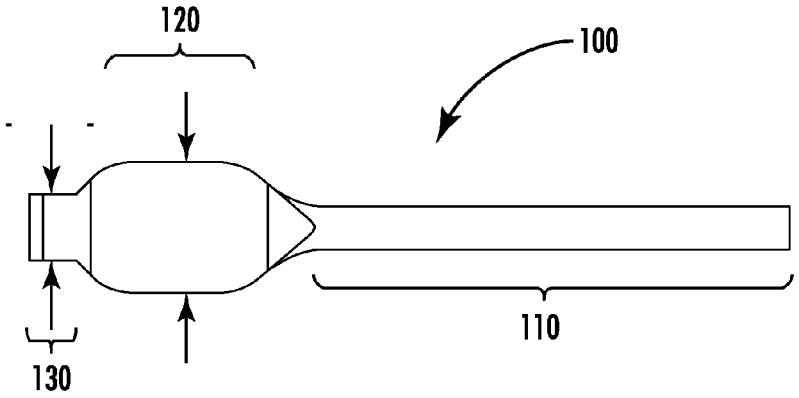
FIG. 1B (PRIOR ART)
Figure 1C:
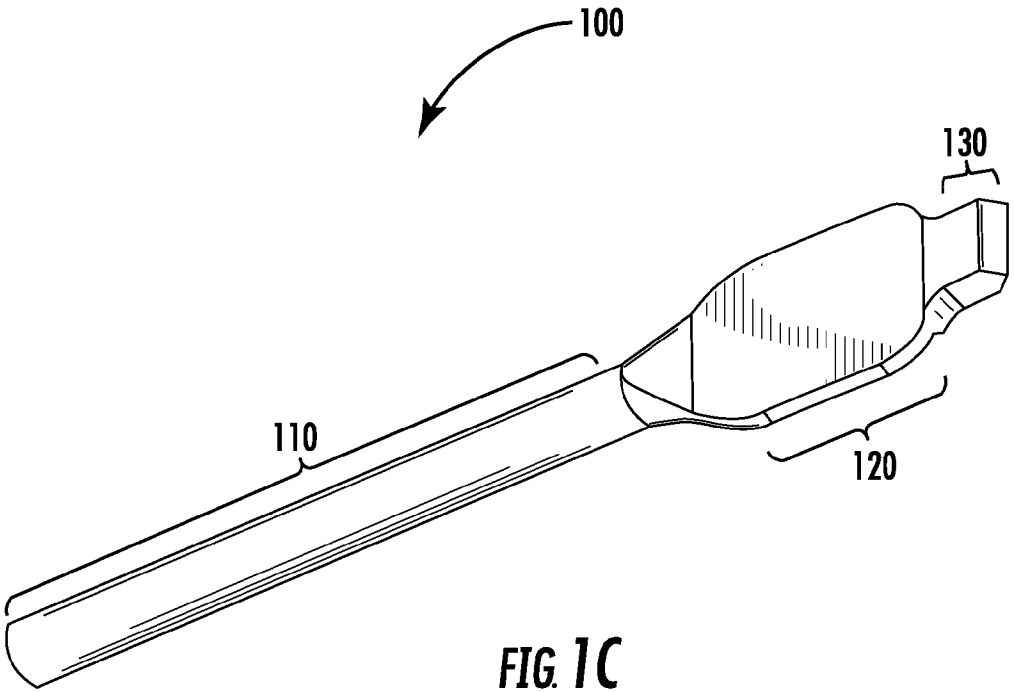
FIG. 1C (PRIOR ART)
FIG. 1C is a perspective view of the reed of FIGS. 1A-1B.

The present disclosure will now be described more fully hereinafter with reference to the accompanying drawings, in which preferred embodiments of the disclosure are shown. This claimed subject matter, however, may be embodied in many different forms and should not be construed as being limited to the embodiments set forth herein. Rather, these embodiments are provided so that this disclosure will be thorough and complete, and will fully convey the scope of the claimed subject matter to those skilled in the art. In the drawings, like numbers refer to like elements throughout.

Figure 2A:
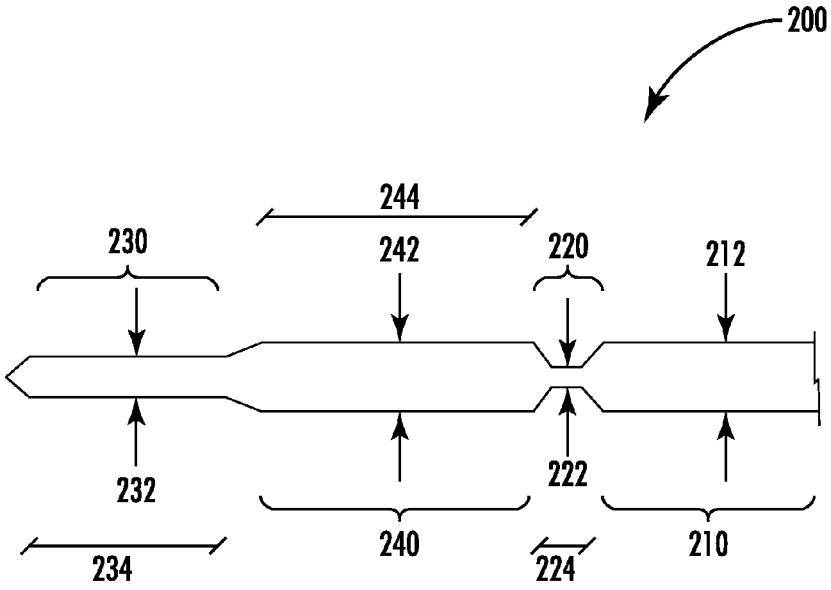
FIGS. 2A-2B are side and top views, respectively of a reed for a reed switch, arranged according to various embodiments of the present disclosure.
Figure 2B:
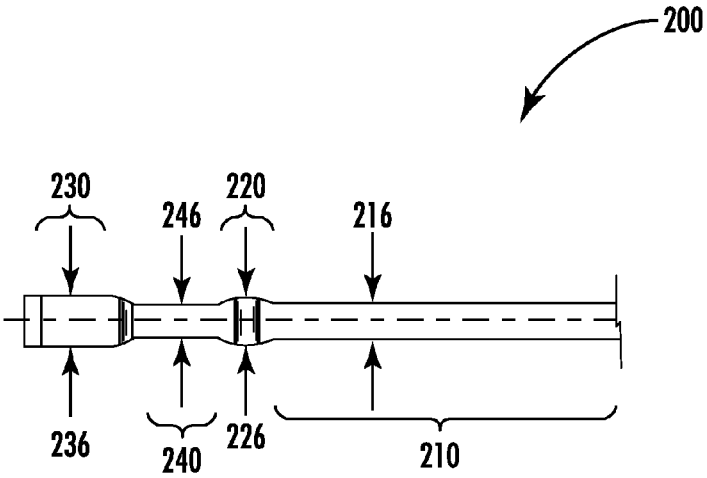

FIGS. 2A-2B are side and top views, respectively, of a reed 200 arranged according to at least some embodiments of the present disclosure. In general, the reed 200 may be any electrically conductive magnetic material. Typically, the reed 200 is formed from an electrically conductive ferromagnetic wire that is generally round in shape (e.g., refer to FIG. 2C). The reed 200 has a first thickness 212, which may correspond to the diameter of the wire used to form the reed 200. With some examples, the reed 200 may be formed from a nickel iron alloy, such as, for example, the nickel iron alloy commonly referred to as alloy 52. With some examples, the reed 200 may be formed from a wire having a diameter of between 0.2 and 1.5 millimeters. As such, the first thickness 212 may be between 0.2 and 1.5 millimeters.

Turning more specifically to FIG. 2A, the reed 200 includes a terminal portion 210, a hinged portion 220, a contact pad portion 230 and an unthinned portion 240. As depicted, the hinged portion 220 is disposed between the terminal portion 210 and the unthinned portion 240. The terminal portion 210 is depicted having the first thickness 212. Each of the hinged portion 220, the contact pad portion 230 and the unthinned portion 240 are also depicted having various thicknesses. More specifically, the hinged portion 220 has a second thickness 222, the contact pad portion 230 has a third thickness 232, and the unthinned portion 240 has a fourth thickness 242. With some examples, the fourth thickness 242 may be substantially equal to the first thickness 212. More specifically, as the terminal portion 210 and the unthinned portion 240 are not flattened, the first and fourth thicknesses 212 and 242 may equal each other or be within some margin of error to each, and as such, be substantially equal.

Furthermore, the hinged portion 220 is shown having a first length 224, the contact pad portion 230 is shown having a second length 234 and the unthinned portion 240 is shown having a third length 244. It is to be appreciated, that FIGS. 2A-2B, although not drawn to scale, are intended to depict the relative relationships between thicknesses and lengths of the various portions of the reed 200 to facilitate understanding of the present disclosure. In particular, the third thickness 232 (corresponding to the thickness of the contact pad portion 230) is less than the first and fourth thicknesses 212 and 242 (corresponding to the thicknesses of the terminal portion 210 and the unthinned portion 240) but greater than the second thickness 222 (corresponding to the hinged portion 220).

Additionally, the first width 216 (corresponding to the width of the hinged portion 220) is less than the second width 226 (corresponding to the width of the contact pad portion 230). Furthermore, the second width 226 (corresponding to the width of the contact pad portion 230) is greater than the third width 236 (corresponding to the width of the unthinned portion 240). It is important to note, that the width of the hinged portion 220 is selected to be small relative to the widths of the other portions of the reed 200 so that the second width 226 (refer to FIGS. 2B and 2C) of the hinged portion 220 will be relatively small compared to the widths of the other flattened portion (e.g., the contact pad portion 230). As such, when the reed is incorporated into a reed switch (refer to FIGS. 4A-4B) the width of the hinged portion will not interfere with movement of the reed 200 during operation of the reed switch. In some examples, for a reed formed from a wire having a diameter of between 0.2 and 1.5 millimeters, the length of the hinged portion may be between 0.04 and 2.25 millimeters. With some examples, the length of the hinged portion may be between 10% and 150% of the diameter of the wire from which the reed is formed.

Turning more specifically to FIG. 2B, a top view of the reed 200 shown in FIG. 2A is illustrated. As depicted, the terminal portion 210 has a first width 216, the hinged portion 220 has a second width 226, the contact pad portion 230 has a third width 236, and the unthinned portion 240 has a fourth width 246. As will be appreciated, when the reed 200 is formed and the hinged portion 220 and the contact pad portion 230 are flattened (e.g., stamped, punched, coined, or the like) the width of these portions will increase. In particular, as illustrated in FIG. 2B, the second width 226 (corresponding to the hinged portion 220) and the third width 236 (corresponding to the contact pad portion 230) are greater than the first width 216 (corresponding to the terminal portion 210) and the fourth width 246 (corresponding to the unthinned portion 240). Furthermore, the third width 236 (corresponding to the contact pad portion 230) is greater than the second width 226 (corresponding to the hinged portion 220).

Figure 2C:
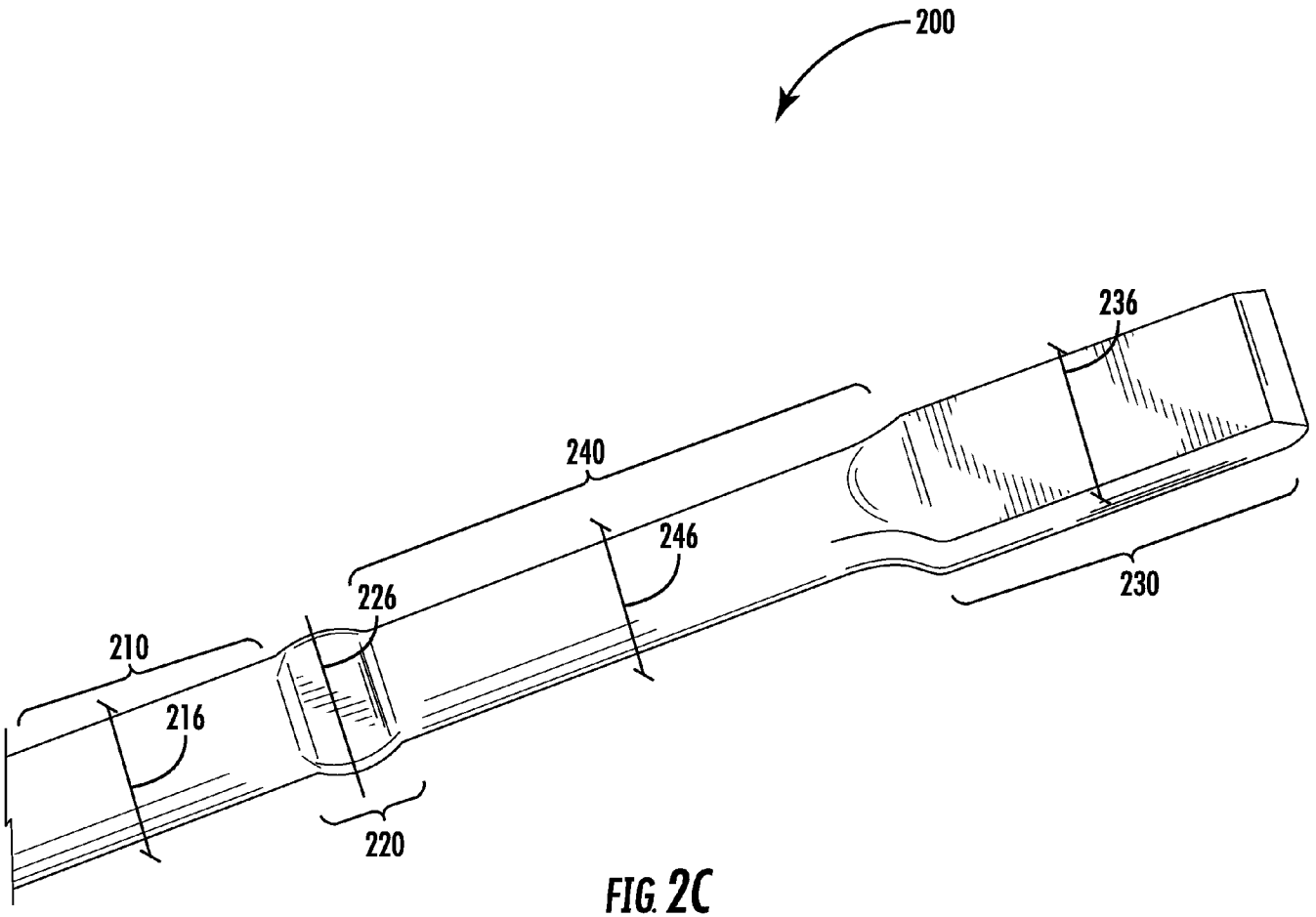
FIG. 2C is a perspective view of the reed of FIGS. 2A-2B.

FIG. 2C illustrates a perspective view of the reed 200 depicted in FIGS. 2A-2B. As can be seen from this figure, the reed 200 is formed from a section of wire that has a generally round shape. The terminal portion 210 and the unthinned portion 240 illustrate this generally round shape. More specifically, as the terminal portion 210 and the unthinned portion 240 are not flattened, they have a substantially uniform thickness and width (e.g., corresponding to the diameter of the wire used to form the reed 200).

The hinged portion 220 is depicted disposed between the terminal portion 210 and the unthinned portion 240. Similarly, the contact pad portion 230 is depicted disposed on the end of the reed 200 distal to the terminal portion 210. More specifically, the unthinned portion 240 is disposed between the hinged portion 220 and the contact pad portion 230. Furthermore, as can be seen from the perspective view of the reed 200 in FIG. 2C, the reed 200 has a first width 216 corresponding to the diameter of the wire used to form the reed 200. Second and third widths 226 and 236 are shown. However, the second and third widths, although greater than the first width, are not substantially greater than the first width. In some examples, the third width 236 may be between 101% and 130% of the first width 216 or 1.01 to 1.30 times the first width. For example, for a reed formed from a wire having a diameter of between 0.2 and 1.5 millimeters and a hinged portion having a length between 0.04 and 1.5 millimeters, the width of the hinged portion may be between 0.21 and 1.95 millimeters.

Accordingly, a reed 200 having a spring rate resulting from the hinged portion 220 is depicted. In particular, the reed 200 may be formed to have a relatively weak spring rate, as may be useful in a reed switch, without making the reed 200 wide. Furthermore, the reed may be formed from a wire having a larger diameter than possible using conventional techniques. As such, reed switches incorporating reeds according to the present disclosure may have higher current carrying capacity and/or to have smaller packages and/or have more sturdy terminals.

Figure 3A:
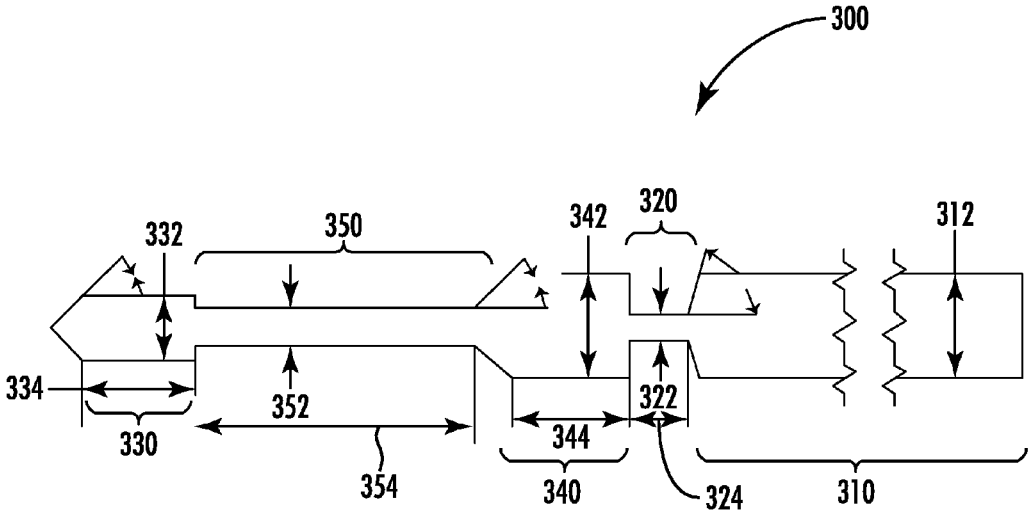
FIGS. 3A-3B are side and top views, respectively of a reed for a reed switch, arranged according to various embodiments of the present disclosure.
Figure 3B:
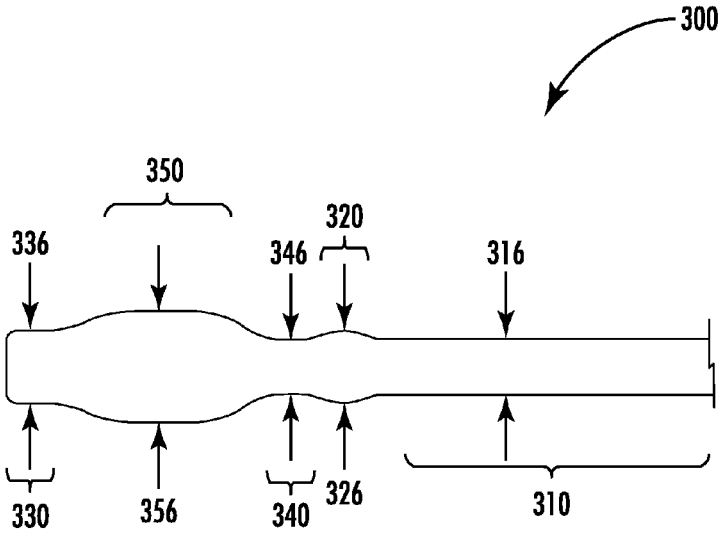

FIGS. 3A-3B are side and top views, respectively, of a reed 300 arranged according to at least some embodiments of the present disclosure. In general, the reed 300 may be any electrically conductive magnetic material. Typically, the reed 300 is formed from an electrically conductive ferromagnetic wire that is generally round in shape (e.g., refer to FIG. 3C). The reed 300 has a first thickness 312, which may correspond to the diameter of the wire used to form the reed 300. With some examples, the reed 300 may be formed from a nickel iron alloy, such as, for example, the nickel iron alloy commonly referred to as alloy 52. With some examples, the reed 300 may be formed from a wire having a diameter of between 0.2 and 1.5 millimeters. As such, the first thickness 312 may be between 0.2 and 1.5 millimeters.

Turning more specifically to FIG. 3A, the reed 300 includes a terminal portion 310, a hinged portion 320, a contact pad portion 330 an unthinned portion 340, and a transition portion 350. With some examples, the transition portion may be provided for purposes of assembling the reed 300 into a reed switch. More specifically, some reed switch mechanical assembly devices may use the transition portion to align the reed with another reed and or an insulating housing (e.g., refer to FIGS. 4A-4B) during the assembly process. It is to be appreciated, that the transition portion is separated from the hinged portion by the unthinned portion (described in greater detail below) to minimize the increase in width 326 which could interfere with the insulating housing, and also to provide that the wider transition portion is further away from the insulating housing in a reed switch so that the transition portion will not interfere with operation of the reed switch.

As depicted, the hinged portion 320 is disposed between the terminal portion 310 and the unthinned portion 340. The terminal portion 310 is depicted having the first thickness 312. Each of the hinged portion 320, the contact pad portion 330, the unthinned portion 340, and the transition portion 350 are also depicted having various thicknesses. More specifically, the hinged portion 320 has a second thickness 322, the contact pad portion 330 has a third thickness 332, the unthinned portion 340 has a fourth thickness 342, and the transition portion 350 has a fifth thickness 352. With some examples, the fourth thickness 342 may be substantially equal to the first thickness 312. More specifically, as the terminal portion 310 and the unthinned portion 340 are not flattened, the first and fourth thicknesses 312 and 342 may equal each other or be within some margin of error to each, and as such, be substantially equal. With some examples, the unthinned portion may refer to a portion that is thinned, however, by a small percentage relative to the first thickness 312. For example, the unthinned portion 340 may have a thickness of between 80% and 100% of the first thickness 312.

Furthermore, the hinged portion 320 is shown having a first length 324, the contact pad portion 330 is shown having a second length 334, the unthinned portion 340 is shown having a third length 344, and the transition portion 350 is shown having a fourth length 354. It is to be appreciated, that FIGS. 3A-3B, although not drawn to scale, are intended to depict the relative relationships between thicknesses and lengths of the various portions of the reed 300 to facilitate understanding of the present disclosure. In particular, the third thickness 332 (corresponding to the thickness of the contact pad portion 330) is less than the first and fourth thicknesses 312 and 342 (corresponding to the thicknesses of the terminal portion 310 and the unthinned portion 340). Additionally, the fifth thickness 352 (corresponding to the transition portion 350) is less than the fourth thickness 342 (corresponding to the unthinned portion 340). Furthermore, the second thickness 322 (corresponding to the hinged portion 320) is usually less than the fifth thickness 352 (corresponding to the transition portion 350).

Additionally, the first length 324 (corresponding to the length of the hinged portion 320) is less than the second length 334 (corresponding to the length of the contact pad portion 330). Furthermore, the second length 334 (corresponding to the length of the contact pad portion 330) is less than the third length 344 (corresponding to the length of the unthinned portion 340). Additionally, the third length 344 (corresponding to the length of the unthinned portion 340) is less than the fourth length 354 (corresponding to the length of the transition portion 350).

It is important to note, that the length of the hinged portion 320 is selected to be small relative to the diameter (which may equal the first thickness 312) of the reed 300 so that the width 326 (refer to FIGS. 3B and 3C) of the hinged portion 320 will be relatively small. As such, when the reed 300 is incorporated into a reed switch (refer to FIGS. 4A-4B) the width of the hinged portion will not interfere with movement of the reed 300 during operation of the reed switch. In some examples, for a reed formed from a wire having a diameter of between 0.2 and 1.5 millimeters, the length of the hinged portion may be between 0.04 and 2.25 millimeters.

Turning more specifically to FIG. 3B, a top view of the reed 300 shown in FIG. 3A is illustrated. As depicted, the terminal portion 310 has a first width 316, the hinged portion 320 has a second width 326, the contact pad portion 330 has a third width 336, the unthinned portion 340 has a fourth width 346, and the transition portion 350 has a fifth width 356. As will be appreciated, when the reed 300 is formed and the hinged portion 320, the contact pad portion 330, and the transition portion 350 are flattened (e.g., stamped, punched, coined, or the like) the width of these portions will increase. In particular, as illustrated in FIG. 3B, the second width 326 (corresponding to the hinged portion 320), the third width 336 (corresponding to the contact pad portion 330), and the fifth width 356 (corresponding to the transition portion 350) are greater than the first width 316 (corresponding to the terminal portion 310) and the fourth width 346 (corresponding to the unthinned portion 340). Furthermore, the third width 336 (corresponding to the contact pad portion 330) is greater than the second width 326 (corresponding to the hinged portion 320). Additionally, the fifth width 356 (corresponding to the transition portion 350) is greater than the third width 336 (corresponding to the contact pad portion 330).

Figure 3C:
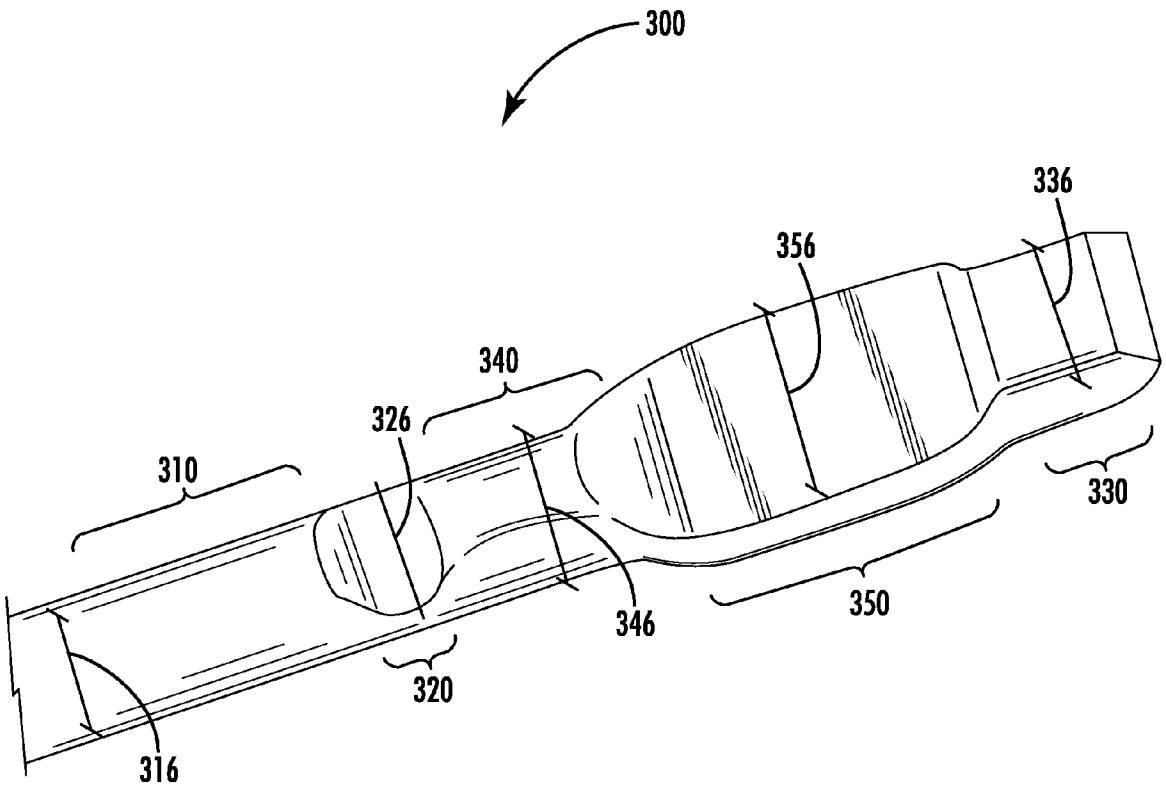
FIG. 3C is a perspective view of the reed of FIGS. 3A-3B.

FIG. 3C illustrates a perspective view of the reed 300 depicted in FIGS. 3A-3B. As can be seen from this figure, the reed 300 is formed from a section of wire that has a generally round shape. The terminal portion 310 and the unthinned portion 340 illustrate this generally round shape. More specifically, as the terminal portion 310 and the unthinned portion 340 are not flattened, they have a substantially uniform thickness and width (e.g., corresponding to the diameter of the wire used to form the reed 300).

The hinged portion 320 is depicted disposed between the terminal portion 310 and the unthinned portion 340. The unthinned portion 340 is depicted disposed between the hinged portion 320 and the transition portion 350. The contact pad portion 330 is depicted disposed on the end of the reed 300 distal to the terminal portion 310. More specifically, the unthinned portion 340 is disposed between the hinged portion 320 and the transition portion 350, while the transition portion 350 is disposed between the unthinned portion 340 and the contact pad portion 330.

Furthermore, as can be seen from the perspective view of the reed 300 in FIG. 3C, the reed 300 has a first width 316 corresponding to the diameter of the wire used to form the reed 300. Second, third and fifth widths 326, 336 and 356 are also shown. However, the second width 326, although greater than the first width 316, is not substantially greater than the first width 316. In some examples, the second width 326 may be between 101% and 130% of the first width 316 or 1.01 to 1.30 times the first width 316. For example, for a reed formed from a wire having a diameter of between 0.2 and 1.5 millimeters and a hinged portion having a length between 0.04 and 2.25 millimeters, the width of the hinged portion may be between 0.21 and 1.95 millimeters.

Accordingly, a reed 300 having a spring rate resulting from the hinged portion 320 is depicted. In particular, the reed 300 may be formed to have a relatively weak spring rate, as may be useful in a reed switch, without making the reed 300 wide. Furthermore, a reed switch design may incorporate a reed having a larger diameter than possible using conventional techniques. As such, reed switches incorporating reeds according to the present disclosure may have higher current carrying capacity and/or to have smaller packages and/or have more sturdy terminals.

Figure 4A:
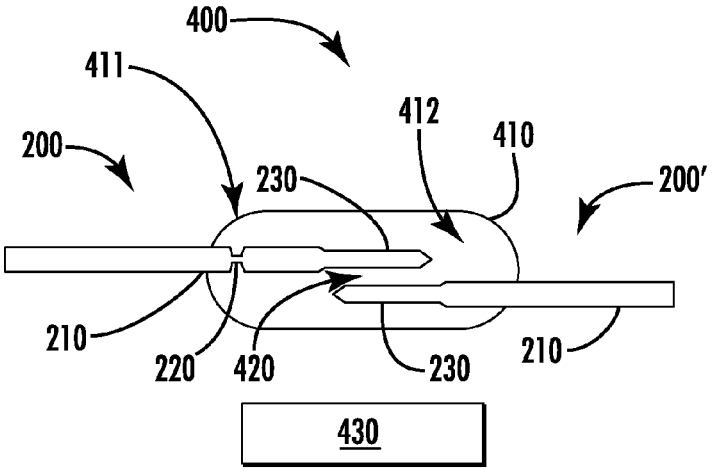
FIG. 4A-4B are cut away side views of a reed switch, arranged according to various embodiments of the present disclosure.
Figure 4B:
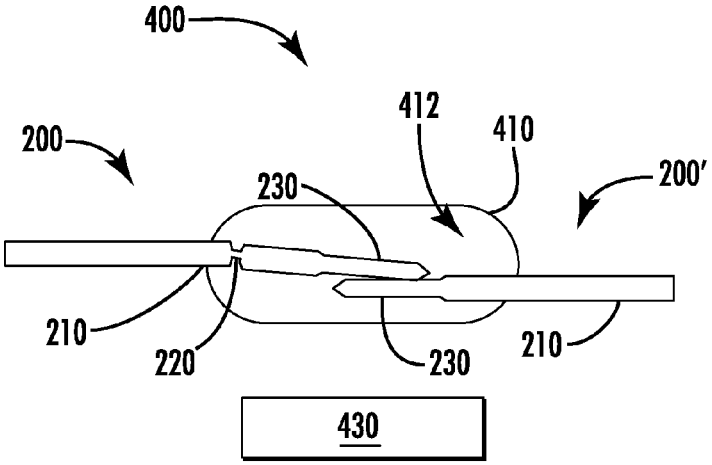

FIGS. 4A-4B are block diagrams illustrating a cut-away view of a reed switch 400. It is important to note, that the reed switch depicted in FIGS. 4A-4B is not drawn to scale, but instead is drawn in a manner to facilitate understanding. For example, in some embodiments, the positioning of the reeds depicted may not be to scale. More specifically, these figures depict portions of the reeds overlapping each other. In practice, the amount of overlap may be significantly less than depicted. The reed switch 400 includes the reed 200 and a reed 200' disposed in an insulating housing 410 with a gap 420 between the reeds. The reed 200 includes the terminal portion 210, the hinged portion 220, and the contact pad portion 230. The reed 200' includes the terminal portion 210 and the contact pad portion 230, but not a hinged portion. It is to be appreciated, that although the reed switch 400 is depicted including the reed 200 and the reed 200', this is not intended to be limiting. For example, with some embodiments, the reed switch 400 may be implemented with either the reed 200 or the reed 300 and an additional reed (e.g., the reed 200', another reed 200, another reed 300, or the like).

The insulating housing 410 includes a void 412 or a cavity in which part of the reed 200 and part of the reed 200' are disposed. With some examples, the insulating housing 410 may be made from glass, or another electrically insulating material. The reeds are disposed in the insulating housing 410 such that the terminal portions 210 extend out of the reed switch 400 and provide points of connecting the reed switch 400 into a circuit.

As depicted in FIG. 4A, the gap 420 between the reed 200 and the reed 200' separates the reeds and prevents electric current from flowing from the terminal portion 210 of the reed 200 to the terminal portion 210 of the reed 200'. Accordingly, the reed switch 400 is in the off or open position in FIG. 4A. It is to be appreciated, that although the reed switch 400 is shown configured as a "normally open" switch, alternative configurations are possible. For example, the reed switch 400 may be configured to be a normally closed reed switch. Examples are not limited in this context.

As described above, the reeds are fixed in the insulating housing 410 so that the terminal portions extend out from the insulating housing. In particular, the reed 200 is disposed in the insulating housing with the hinged portion 220 adjacent to the wall 411 of the insulating housing 410. During operation, the reed 200 is deformed to cause the contact portions 230 of the reeds 200 and 200' to physically touch to close the reed switch and provide a path for conduction of electric current between the terminals portions 210.

Accordingly, the reed switch 400 may include a reed deformer 430 to deform the reed 200 to close the switch. With some examples, the reed deformer 430 may be an electric magnet that is turned on to apply a magnetic force to the reed 200 to deform the reed 200. In some examples, the reed deformer 430 may be a permanent magnet that is mechanically moved to apply a magnetic force to the reed 200 to deform the reed 200. As such, during operation, when the reed switch 400 is to be closed, the reed deformer may cause the reed 200 to deform. More specifically, the reed 200 may deform in multiple portions but especially in portion 220 and as a result physically contact the contact pad 230 of the reed 200'. This is illustrated in FIG. 4B. As depicted, the reed 200 is deformed (e.g., from that shown in FIG. 4A) and the contact pads 230 now physically touch. More specifically, the gap 420 is closed or is sufficiently closed to allow the conduction of electric current between the terminal portions 210.

As noted above, FIGS. 4A-4B may not be to scale. For example, with some embodiments, the reed 200 and the reed 200' may overlap between 10 and 20 times the distance of the gap 420. In some examples, the gap may be approximately 0.02 mm. With some examples, the gap may be between 0.004 mm and 0.1 mm. In some examples, reed 200 and the reed 200' may overlap between 0.1 mm and 1.2 mm.

Figure 5:
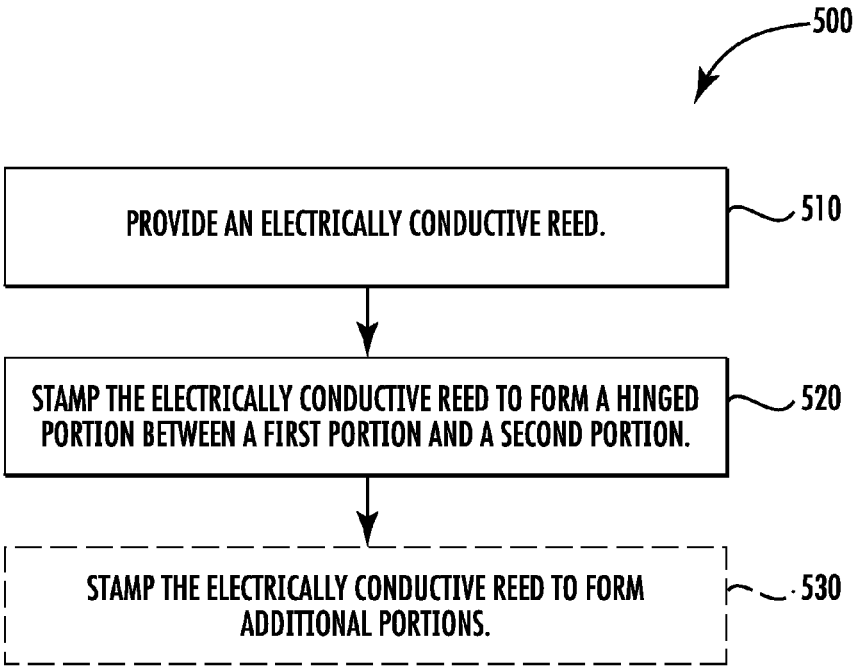
FIG. 5 is block diagram of a method for making a reed for a reed switch, arranged according to various embodiments of the present disclosure.

FIG. 5 illustrates a logic diagram of a method 500 for forming a reed according to some embodiments of the present disclosure. Although the method 500 is described with reference to FIGS. 2A-2C and the reed 200, examples are not limited in this context. For example, the method 500 may be used to form the reed 300, or another reed. Beginning at block 510, provide an electrically conductive reed, the reed 200 may be provided. Continuing to block 520, stamp the electrically conductive reed to form a hinged portion between a first portion and a second portion, the hinged portion 220 may be stamped in the reed 200. Optionally, the method may include block 530, stamp the electrically conductive reed to form additional portions, the contact pad portion 230 and/or the transition portion 240 may be stamped in the reed 200. The stamping operations (e.g., block 520 and block 530) may be performed in a single stamping operation, or in any number of stamping operations. With some examples, the method 500 may be implemented to form multiple reeds from a portion of a wire. The reeds may be stamped (e.g., by application of blocks 510, 520, and/or 530) and then separated from the portion of the wire.

The invention claimed is:

1. A reed for a reed switch comprising:

a first portion having a first thickness and a first length;

a second portion having a second thickness and a second length;

a hinged portion disposed between the first portion and the second portion, the hinged portion having a third thickness and a third length, wherein the third length is less than 150% of the first thickness and the third thickness is less than each of the first thickness and the second thickness; and a third portion extending directly from an end of the second portion distal to the hinged portion, the third portion having a fourth thickness and a fourth length, wherein the fourth thickness is less than the second thickness and greater than the third thickness.

2. A reed switch comprising:

a first electrically conductive reed comprising:

a terminal portion; and a first portion;

a second electrically conductive reed comprising:

a terminal portion having a first thickness and a first length;

a first portion having a second thickness and a second length; and a hinged portion disposed between the terminal portion and the first portion, the hinged portion having a third thickness and a third length; and a second portion extending directly from an end of the first portion distal to the hinged portion, the second portion having a fourth thickness and a fourth length, wherein the fourth thickness is less than the second thickness and greater than the third thickness; and an insulating housing having a cavity;

wherein the first electrically conductive reed and the second electrically conductive reed are partially disposed in the insulating housing such that the terminal portions extend out from the insulating housing and the first portions are proximate to each other in the cavity; and wherein the third length is less than 150% of the first thickness and the third thickness is less than each of the first thickness and the second thickness.

3. The reed switch of claim 2, wherein the first portion of the first electrically conductive reed is separated from the second portion of the second electrically conductive reed by a gap, the reed switch further comprising a reed deformer configured to deform the second electrically conductive reed to close the gap during an on state of the reed switch.

4. The reed switch of claim 2, wherein the insulating housing is formed from glass.

5. The reed switch of claim 2, wherein the second electrically conductive reed is disposed in the insulating housing such that the hinged portion is proximate to an inner wall of the insulating housing.

6. A reed switch comprising:

a pair of electrically conductive reeds, each of the electrically conducive reeds comprising:

a terminal portion having a first thickness and a first length;

a first portion having a second thickness and a second length; and a hinged portion disposed between the terminal portion and the first portion, the hinged portion having a third thickness and a third length; and a second portion extending directly from an end of the first portion distal to the hinged portion, the second portion having a fourth thickness and a fourth length, wherein the fourth thickness is less than the second thickness and greater than the third thickness; and an insulating housing having a cavity;

wherein the pair of electrically conductive reeds are partially disposed in the insulating housing such that the terminal portions extend out from the insulating housing and the second portions are proximate to each other in the cavity, and wherein the third length is less than 150% of the first thickness and the third thickness is less than each of the first thickness and the second thickness.

* * * * *